United States Patent [19]

Svensson et al.

[11] Patent Number: 4,596,280

[45] Date of Patent: Jun. 24, 1986

[54] DRUM FOR STRIPPING OR PRE-TREATING TREES OR LIKE PLANTS

[75] Inventors: Sven A. Svensson, Själevad; Bo J. M. Oledal, Frösön, both of Sweden

[73] Assignee: KMW Aktiebolag, Karlstad, Sweden

[21] Appl. No.: 656,875

[22] Filed: Oct. 2, 1984

[30] Foreign Application Priority Data

Dec. 16, 1981 [SE] Sweden ..... 8107559

[51] Int. Cl.[4] ..... B27L 1/02

[52] U.S. Cl. ..... 144/208 B; 144/2 Z

[58] Field of Search ..... 144/208 R, 208 B, 2 Z; 241/153, 163

[56] References Cited

U.S. PATENT DOCUMENTS

| | | | |
|---|---|---|---|
| 2,665,721 | 1/1954 | Busch | 144/208 |
| 2,688,350 | 9/1954 | Waller | 144/208 |
| 3,086,569 | 4/1963 | Sandison | 144/208 |
| 3,272,245 | 9/1966 | Dick et al. | 144/208 B |
| 3,896,863 | 7/1975 | Smiltneek | 144/208 B |
| 3,973,606 | 8/1976 | Carbonneau | 144/208 B |
| 4,445,558 | 5/1984 | Banner et al. | 144/208 B |

FOREIGN PATENT DOCUMENTS 52015 1/1933 Norway .

*Primary Examiner*—W. D. Bray

*Attorney, Agent, or Firm*—Bell, Seltzer, Park & Gibson

[57] ABSTRACT

A drum for stripping branches, bark and like so-called waste from trees or like woody plants, or for at least pre-treating the trees or like woody plants in a manner to soften or crush the branches and bark thereon, comprises a plurality of mutually co-axial drum sections (1–6). For the purpose of preventing a tree from being lifted in the drum under the action of obliquely positioned stripping bars, the drum sections are rotated alternately in clockwise and anti clockwise directions, which also prevents the tree from being rotated about its longitudinal axis. The stripping bars, which co-act with openings (22, 23, 24) through which removed waste material is released from the drum, are obliquely positioned relative to the axis of rotation (27) of the drum. The stripping bar of each drum section is obliquely positioned relative to the stripping bar of an adjacent drum section.

8 Claims, 5 Drawing Figures

DRUM FOR STRIPPING OR PRE-TREATING TREES OR LIKE PLANTS

Figure 1:
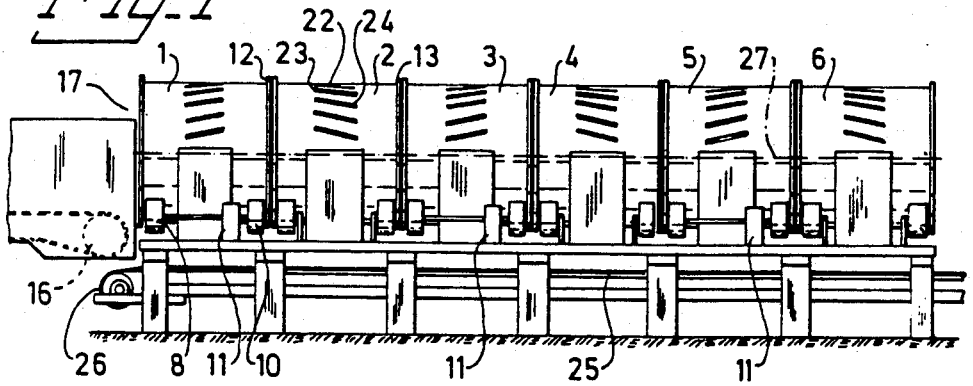

The present invention relates to a drum for stripping branches, bark and like so-called waste from trees or like woody plants, or for at least pre-treating said trees or like woody plants in a manner to soften or crush said branches and said bark thereon, said drum comprising a plurality of mutually co-axial drum sections, of which alternate drum sections are driven in a first direction of rotation at a given speed and the intermediate drum section or sections has or have a relative rotary speed which deviates from said given speed, and which drum sections are provided with obliquely positioned slot-like openings and with internal scrapers or pruning chisels which are arranged to remove said so-called waste material and to advance a tree under treatment in the axial direction of the substantially horizontal drum.

There has long been a need for lightweight drums of the aforementioned kind which can be readily transported in off-road areas, to enable trees, tree tops and the like to be treated directly in the cutting or logging area, and to recover for the cellulose industry valuable raw materials, while at the same time recovering branches, needles, bark etc., which are important fuel sources. When viewed from the aspect of cost, it is impossible to treat such material manually, which has hitherto solely been considered as waste, and neither is it possible to use conventional debarking drums, inter alia because they cannot be readily transported in off-road areas and are less effective in removing branches and the like from small trees etc.

One of the reaons why a conventional barking drum is not suitable for debranching spruce tops, for example, is because the input material is lifted up by the barking bars, to then fall towards the bottom of the drum. When feeding slender trees, tree tops or like material into the drum, there is a risk that the trees will bend inside the drum and either jam solid or be broken into small pieces of lesser value.

In order to obtain the best possible trimming results, it is necessary that the tree or trees constantly lies or lie, on the bottom or the bottom part of the drum, and rotated to a certain extent, which enables a tree to be stripped around the whole of its trunk. This rotation of the tree is effected by means of known internal strippers or pruning chisels positioned obliquely relative to the substantially horizontal rotary axis of the drum. In order for the branches to be pruned-off close to the trunk of the tree, the rotary speed of the tree must be low in relation to the rotary speed of the drum. In certain instances it is also necessary to prework trees, branches and like materials having very tough and difficulty removed bark, for example eucalyptus bark, which has very long fibres. When pre-working such trees and like plants, they are subjected to processes which enable the bark to be more readily removed in a subsequent stripping drum.

Accordingly a prime object of the present invention is to provide a stripping or pre-working drum of the kind described in the introduction, in which trees, tree tops and the like fed into the drum whilst the drum is rotating are in contact with the bottom part of the drum and are caused to slowly rotate about their long axis while being fed axially through the drum.

This object is fully realised by means of the invention set-forth in the following claims.

Since each drum section has a length which is smaller than the length of a tree fed to the drum, and since mutualy adjacent drum sections are driven in mutually opposite directions, one end of the tree will always be located within one drum section while the other end of the tree will be located within an adjacent drum section, thereby preventing the tree from being rapidly rotated, while the mutually counter-acting stripping irons or pruning chisels prevent, at the same time, the tree from being lifted up in the manner occurent in conventional barking drums. As beforementioned, when slender tree tops etc. are lifted in the drum, there is a risk that they will jam solid and/or be crushed into pieces of less value.

Figure 2:
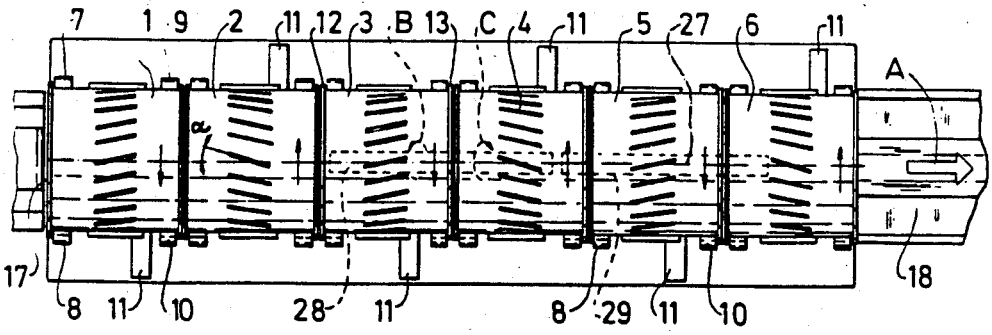
Figure 3:
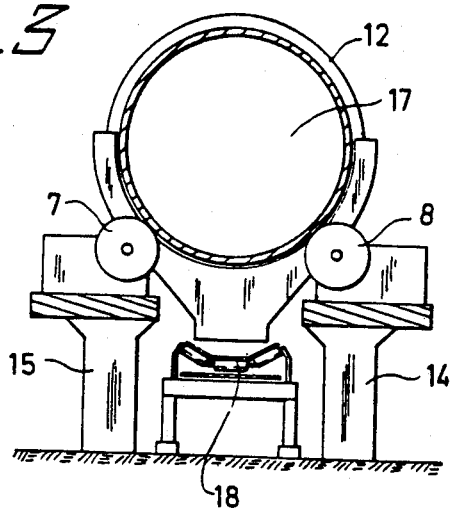
Figure 4:
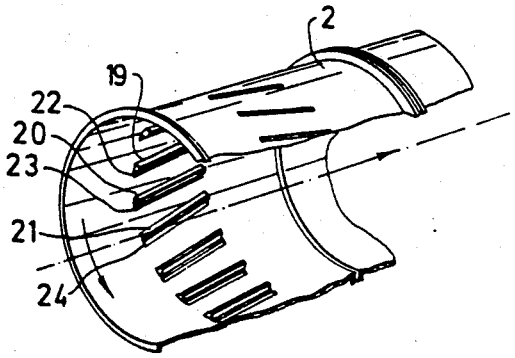
Figure 5:
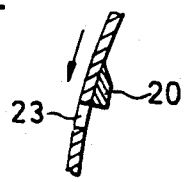

The invention will now be described in more detail with reference to the accompanying drawings, in which FIG. 1 is a side view of a stripping or pretreatment drum according to the invention, FIG. 2 is a top-plan view of the drum illustrated in FIG. 1, FIG. 3 is an end view of the drum illustrated in FIGS. 1 and 2, FIG. 4 is a cut-away view of a drum section, and FIG. 5 is a sectional view of part of the drum wall.

Illustrated in the drawings is a stripping or pretreatment drum comprising six drum sections 1, 2, 3, 4, 5 and 6 which can be rotated independently of one another. Each of the drum sections is supported by four rollers or wheels 7, 8, 9 and 10. In the illustrated embodiment, two of the wheels, for example wheels 8 and 10, are driven by a common drive means, for example a hydraulic or an electric motor. Each drum section has on the ends thereof annular flanges 12, 13 which project beyond the outer cylindrical surface of the drum sections and which extend in, over the sides of the wheels and prevent any appreciable displacement axially of respective drum sections. It is assumed in the illustrated embodiment that the drum sections are mutually of the same length axially, although this is no prerequisite. As indicated by the arrows shown in respective drum sections in FIG. 2, each alternate drum section is driven in a first direction and the remaining, intermediate drum sections are rotated in an opposite direction by means of associated drive means 11. As will be seen from FIG. 2, the drum sections 1, 3 and 5 are thus driven clockwise, as seen in the direction in which the trees are fed, this being shown by the arrow A, and the remaining drum sections 2, 4 and 6 are driven anticlockwise. As will best be seen from FIG. 3, all drum sections, together with their respective wheels and drive means, are carried on two longitudinally extending spaced apart supports 14 and 15, and that arranged between said supports is a roller conveyor, or like device 16 by means of which the tree, tree top or like material to be trimmed or stripped is fed in through the open end 17 of the drum section 1 and then, subsequently to being completely trimmed, fed out through the similarly open end of the last drum section 6, to be conveyed further to a subsequent station on a conveyor means as shown in simplified fashion at 18.

Elongate stripping bars or pruning chisels, for example stripping bars 19, 20 and 21 (FIG. 4) are arranged on the inner cylindrical wall of each drum section, and as will be seen from FIG. 5 each stripping bar, when seen in the direction of rotation of the drum section, lies immediately adjacent the trailing edge of an elongate opening, for example openings 22, 23 and 24, through which branches, bark and like waste material suitable for use as fuel falls out from the drum and down onto a conveyor 25 arranged therebeneath. This conveyor suitably has the form of an endless belt conveyor moving over rollers, such as the roller 26. As will be seen from FIGS. 1, 2 and 4, the openings, or slots, which extend parallel with the stripping bars, are positioned obliquely in relation to the substantially horizontal rotary axis 27 of the drum. The angle $\alpha$ (FIG. 2) between a stripping bar and the axis 27 may vary within wide limits, depending upon the length of the tree fed to the drum, although in order to obtain the requisite propelling force the angle should be at least 15°. As beforementioned, the drum consists of mutually coaxial drum sections 1–6, which have mutually the same internal diameter, and since the drum sections are rotated in alternate directions the stripping bars and openings in one drum section must be obliquely positioned in relation to the stripping bars in an adjacent drum section, as illustrated in FIGS. 1 and 2, in order for a tree to be transported through the whole of the drum. Thus, from a tree-propelling aspect the stripping bars or pruning chisels will act in one and the same direction. It is important in accordance with the invention that a tree 28, shown in broken lines in FIG. 2, is subjected to a lifting and rotating force B when its one end part is worked by means of the stripping bars in, for example, the drum section 3, while the other end part of the tree is subjected to a counter-acting force C in the adjacent drum section 4. In this way the tree, or trees, will be prevented from being lifted and rapidly rotated about its longitudinal axis, or about their longitudinal axes, since the forces B and C are of substantially the same magnitude, while allowing the tree or trees to be freely advanced through the drum. In some cases, depending upon the length of each drum section, the length of the stripping bar or pruning chisel and the length of the tree being treated, it may happen, as indicated at 29, that the tree is worked by the stripping bars of only one drum section, in the illustrated case drum section 5, and that there is subsequently a tendency for the tree to be lifted and to be rotated so rapidly that the branches are not removed. This circumstance is short lived, however, since the tree is constantly moving axially and is rapidly caught by means of the stripping bars in the drum section 6, whereupon the speed at which the tree rotates quickly falls and the tendency of the tree to be lifted is eliminated. The stripping bars, or pruning chisels, are suitably as long as possible, so that a tree is constantly worked in two drum sections, and each drum section is given an axial length which is smaller than the lengths of the trees being worked.

As an example of suitable dimensions in this respect, wood lengths of from 2 to 2.5 meters are estimated when treating trees in Scandanavia. A suitable drum for treating trees cut to such lengths has an internal diameter of 1.6 meters and the total, combined length of the drum is about 7 meters, divided into the illustrated six drum sections, which are here assumed to be of mutually the same length. In this case, the slot-like openings are 35×700 mm in size and the stripping bars or pruning chisels welded obliquely to the inner surface of the drum have a height of 10–100 mm. Since the trees will not be lifted up and subsequently fall onto the bottom of the drum, the drum sections can be made of a relatively thin metal sheet, for example sheet having a thickness of 15 mm, as compared to the sheet thickness of a conventional barking drum, which is at least 30 mm.

In the aforegoing it has been assumed that the drum sections 1–6 are mutually identical, with the exception of the directions in which they rotate and the mutual angles at which the stripping bars are placed, although there is nothing to prevent the drum sections having different axial lengths, mutually different rotary speeds and mutually different sized stripping bars.

We claim:

1. A drum for stripping or pre-treating trees or the like so as to soften, crush or remove branches and bark therefrom, and which is particularly desirable for use in delimbing tree top segments and smaller trees, said drum comprising a plurality of mutually coaxial cylindrical drum sections of substantially the same diameter, a plurality of stripping bars mounted on the interior of each respective drum section at an angle of at least fifteen degrees to the axis of rotation of the drum, the stripping bars in each drum section being oriented in oblique relation to the stripping bars in an adjacent drum section, openings provided in each drum section for discharging waste material from the interior of the drum sections, and drive means cooperating with the cylindrical drum sections for rotating alternate drum sections about the axis of rotation in a first direction of rotation and for rotating intermediate drum sections in the opposite direction from said first direction of rotation.

2. A drum according to claim 1 wherein said drive means are adapted for rotating said alternate cylindrical drum sections at a first rotary speed while intermediate drum sections are rotated at a second rotary speed which deviates from the first rotary speed.

3. A drum according to claim 1 wherein said drum sections are of substantially the same axial length.

4. A drum according to claim 1 wherein the length of each of said drum sections is less than the length of the tree sections to be stripped or pre-treated in said drum.

5. A drum according to claim 1 wherein said openings for discharging waste material are positioned in substantially parallel relation to said plurality of stripping bars within each of said drum sections.

6. A drum according to claim 5 wherein said stripping bars are positioned in adjacent relation to an associated opening for discharging waste material.

7. A drum for stripping or pre-treating trees or the like so as to soften, crush or remove branches and bark therefrom and which is particularly desirable for use in delimbing tree top segments and smaller trees, said drum comprising a plurality of mutually coaxial cylindrical drum sections of substantially the same diameter, a plurality of stripping bars mounted on the interior of each respective drum section at an angle of at least fifteen degrees to the axis of rotation of the drum, the stripping bars in each drum section being oriented in oblique relation to the stripping bars in an adjacent drum section, openings provided in each drum section and positioned in association with and in parallel relation to the stripping bars for discharging waste material from the interior of the drum sections, and drive means cooperating with the cylindrical drum sections for rotating alternate drum sections about the axis of rotation in a first direction of rotation and at a first rotary speed and for rotating intermediate drum sections in the opposite direction from said first direction of rotation and at a second rotary speed which deviates from the first rotary speed.

8. A drum according to claim 7 wherein said stripping bars and openings are so positioned and arranged that when a drum section is viewed in the direction of rotation, each stripping bar will lie behind an associated opening.

* * * * *